US009340054B2

(12) United States Patent
Tang et al.

(10) Patent No.: US 9,340,054 B2
(45) Date of Patent: May 17, 2016

(54) METHOD FOR PRODUCING A PATTERNED INSULATION BOARD USED FOR EXTERIOR WALL OF BUILDING BY USING SCREEN PRINTING

(71) Applicant: LIAONING CHAOSHUO TOMA TECHNOLOGY STEEL PLATE PRINTING CO., LTD., Yingkou, Liaoning (CN)

(72) Inventors: Yueping Tang, Yingkou (CN); Jianping Zhou, Yingkou (CN); Liang Wu, Yingkou (CN)

(73) Assignee: LIAONING CHAOSHUO TOMA TECHNOLOGY STEEL PLATE PRINTING CO., LTD., Yingkou (CN)

( * ) Notice: Subject to any disclaimer, the term of this patent is extended or adjusted under 35 U.S.C. 154(b) by 0 days.

(21) Appl. No.: 14/778,719

(22) PCT Filed: Jun. 28, 2013

(86) PCT No.: PCT/CN2013/078415

§ 371 (c)(1),
(2) Date: Oct. 29, 2015

(87) PCT Pub. No.: WO2014/146377

PCT Pub. Date: Sep. 25, 2014

(65) Prior Publication Data

US 2016/0052321 A1 Feb. 25, 2016

(30) Foreign Application Priority Data

Mar. 19, 2013 (CN) ..... 2013 1 0089147

(51) Int. Cl.

| | |
|---|---|
| ***B41M 1/12*** | (2006.01) |
| ***B41F 15/18*** | (2006.01) |
| ***E04F 13/08*** | (2006.01) |
| ***E04F 13/12*** | (2006.01) |

(52) U.S. Cl.

CPC ..... *B41M 1/12* (2013.01); *E04F 13/0866* (2013.01); *E04F 13/0871* (2013.01); *E04F 13/0875* (2013.01); *E04F 13/12* (2013.01)

(58) Field of Classification Search

CPC ..... B41M 1/12; B41F 15/0881; B41F 15/12; B41F 15/16; B41F 15/18; B41F 15/20; B41F 15/26; B41P 2215/50; E04F 13/12; E04F 13/075; B05D 1/28

USPC ..... 101/126, 129

See application file for complete search history.

(56) References Cited

U.S. PATENT DOCUMENTS

| | | | | |
|---|---|---|---|---|
| RE25,134 | E * | 3/1962 | Kinzelman | B41F 13/02 101/178 |
| 5,476,039 | A | 12/1995 | Hiruta et al. | |
| 5,830,307 | A | 11/1998 | Hiruta et al. | |

FOREIGN PATENT DOCUMENTS

| | | | |
|---|---|---|---|
| CN | 1119990 | A | 4/1996 |
| CN | 1305893 | A | 8/2001 |
| CN | 201301525 | Y | 9/2009 |
| CN | 201318007 | Y | 9/2009 |
| CN | 102322103 | A | 1/2012 |
| CN | 202298992 | U | 7/2012 |
| DE | 19811152 | A1 | 9/1999 |
| JP | H07-1702 | A | 1/1995 |
| JP | H07-156363 | A | 6/1995 |

OTHER PUBLICATIONS

Nov. 28, 2013 International Search Report issued in Chinese Patent Application No. PCT/CN2013/078415.

* cited by examiner

*Primary Examiner* — Leslie J Evanisko
(74) *Attorney, Agent, or Firm* — Oliff PLC

(57) ABSTRACT

A method for producing a patterned insulation board used for exterior wall of building by using screen printing, and the patterned insulation board comprising a metal veneer, a substrate an insulation layer between the metal veneer and the substrate, and the method comprising a step of screen printing the metal veneer, wherein, a flattening device is arranged at a bottom of the printing table, and used to flatten a surface of metal veneer, prior to the screen printing. The flattening device makes the scraper transfer ink by uniform force, which reduces printing difficulties overcome the printing difficulty.

3 Claims, No Drawings

METHOD FOR PRODUCING A PATTERNED INSULATION BOARD USED FOR EXTERIOR WALL OF BUILDING BY USING SCREEN PRINTING

FIELD OF INVENTION

The present invention relates to a screen printing method for production of patterned insulation board used for building exterior wall, belonging to the field of patterned insulation board manufacturing.

BACKGROUND OF THE INVENTION

It is future development trend to manufacture and use green building materials to construct green buildings in the construction field. A concept of "promoting green development, cyclic development, low-carbon development" and "Construct Wild China" was put forward by 18th CPC National Congress which was just closed. With the development of urbanization, a large number of housing which have not reached their service life are removed due to the damage of the wall insulation veneer, causing serious influence on the green development of city.

Exterior wall insulation includes single material (aerated concrete, sintered insulating brick, etc.) exterior wall insulation and composite material exterior wall insulation (interior thermal insulation, exterior thermal insulation, sandwich thermal insulation and block thermal insulation, etc.). Although there are many ways of exterior wall insulation, few of them realize an integration of decoration and insulation, and in order to meet the decoration requirement, it is necessary to construct a decorative layer on the surface of an insulation layer after construction of the insulation layer. However, since the insulation layer has been constructed on a wall, then it is very inconvenient to add a decorative layer onto the insulation layer.

After much trial and error, the applicant develops an exterior wall insulation board which realizes integration of insulation and decoration. The insulation board comprises a metal veneer and a substrate oppositely arranged with an insulation layer disposed therebetween. The applicant firstly screen prints a multicolor pattern on the metal veneer by using a screen printing machine, and then glues the metal veneer, the insulation layer and the substrate together to form the exterior wall insulation board which is finally constructed on an exterior wallbody. It provides much more convenience for processing the decorative layer, compared with the traditional way by which an insulation layer is installed firstly followed by constructing a decorative layer.

However, during the process of using the screen printing machine, the applicant found out that, in screen printing process, a certain pressure has to be applied to ink by using the scraper, accordingly the ink is capable of penetrating through some mesh of image area and forms required patterns or code bar on a substrate; and if the substrate is a paper, it will be flat when tiling on a printing table, thus printing various parts can be performed under a uniform force applied by the scraper on the ink; the substrate may also be a steel plate, and most of steel plates are hot rolled or cold rolled, and in the hot rolling or cold rolling process, the steel plate is usually changed shape, as a result the steel plate cannot be completely flattened (i.e. the steel plate is in a bent status that both ends upwarp and the center part contacts the printing table, or the center part upwarps and both ends contact the printing table), thereby the printing cannot be achieved when the scraper applies the uniform force to the substrate, which increases the difficulty of printing; more importantly, because the steel plate is unevenness, the scraper has to apply a force on the steel plate when both are in line contact, however, relying entirely on the scraper cannot ensure the flatness; in addition, the screen printing forme and the steel plate have a great strength difference, therefore, it is a technical problem of how to balance of strength difference of the screen printing forme and the steel plate.

In conclusion, when printing patterns on the steel plate by using the screen printing machine, it is an unsolved technical problem of how to overcome the printing difficulty because the steel plate is unevenness in the prior art.

SUMMARY OF THE INVENTION

Therefore, the technical problem to be solved by the present invention is to provide a screen printing method for production of a patterned insulation board, by which the technical problem of how to overcome the printing difficulty because the steel plate is unevenness in the prior art can be solved.

In order to solve the above mentioned technical problem, the present invention provides a method for producing a patterned insulation board used for exterior wall of building by using screen printing, comprising in sequence the following steps of A. producing a metal veneer and a substrate; and B. arranging an insulation layer between the metal veneer and the substrate to form the patterned insulation board;

wherein, the process of producing a the metal veneer in step A comprises in sequence the following steps of a. producing a metal plate;

b. treating the metal plate before printing patterns;

c. printing patterns on the metal plate by using screen printing equipment which comprises a screen printing machine used for printing patterns on the metal plate and a printing table used for placing the metal plate to be printed, so as to form the metal veneer; a flattening device is arranged at a bottom of the printing table, and used to flatten a surface of metal plate, prior to the screen printing.

In a class of embodiments, the printing table is made of ferromagnetic material, and a magnet coil is arranged at a lower part of the printing table corresponding to a placement position of the metal plate and is connected with an energizing control device.

In a class of embodiments, a plurality of through holes are arranged at the printing table corresponding to the placement position of the metal plate, and a fan is arranged at the bottom of the printing table and adapted for sucking air through the through holes.

In a class of embodiments, the screen printing equipment comprises an infrared ray curing oven for curing the patterns and code bar, which is compatible with the screen printing machine.

In a class of embodiments, in the step a, the metal plate is produced by a process comprising in sequence the following steps of: hot rolling steel coils, acid pickling the hot rolled steel coils, cold rolling the acid pickled steel coils, and continuously hot dip galvanizing the cold rolled steel coils to form the metal plate.

In a class of embodiments, in the step b, before printing the patterns, the metal plate is treated by following treatment process of: degreasing treatment, cleaning treatment, first drying treatment, passivating treatment, second drying treatment, coating primer paint treatment, baking for curing treatment, and cooling treatment.

In a class of embodiments, in the step B, the patterned insulation board is produced by the following process of: firstly, treating the metal veneer and the substrate respectively by coating, pressing and gluing, and gluing the insulating layer, and then arranging the insulation layer between the metal veneer and the substrate and pressing to form the patterned insulation board.

In a class of embodiments, in the step B, rock wool with a density of 120 kg/m$^3$ is used as the insulation layer, and the fiber orientation of the rock wool is perpendicular to the metal veneer and the substrate.

In a class of embodiments, in the step B, a polyurethane foaming agent is used in the gluing treatment.

In a class of embodiments, in the step B, after the insulation layer is arranged between the metal veneer and the substrate and is treated by pressing to form the patterned insulation board, and the polyurethane foaming agent is used for sealing edge of the patterned insulation board.

The present invention providing a method for production of a patterned insulation board used for building exterior wall has advantages in the following:

1. The present invention provides a method for producing a patterned insulation board used for exterior wall of building by using screen printing, wherein a flattening device is arranged at a bottom of the printing table, and flattens the shear shaped metal plate which has been treated by hot rolling and cold rolling, thereby the scraper can transfer ink by uniform force, which reduces printing difficulties. The present invention provides a flattening method of method 1 in detailed as follows: the printing table is made of ferromagnetic material, and a magnet coil is arranged at a lower part of the printing table corresponding to a placement position of the metal plate and is connected with an energizing control device which is controlled to make the magnet coil energized when flattening so that the printing table is magnetized and the magnetized printing table attracts the metal plate and flattens the same; Method 2, a plurality of through holes are arranged at the printing table corresponding to a placement position of the strip steel, and a fan is arranged at a bottom of the printing table and adapted for sucking air through the through holes, when flattening used this method, it will form a gap between the metal plate and the printing table due to unevenness, therefore, when the fan sucks air through the through holes, negative pressure area in a clearance space may be formed by the strip steel and the printing table, and the strip steel is further pressed towards the printing table, and the flattening is completed. The above two flattening devices have simple construction and are easy to operate.

2. The present invention provides a method for producing a patterned insulation board used for exterior wall of building by using screen printing. In the step a, the metal plate is produced by a process comprising in sequence the following steps of: hot rolling steel coils, acid pickling the hot rolled steel coils, cold rolling the acid pickled steel coils, and continuously hot dip galvanizing the cold rolled steel coils to form the metal plate. The hot rolling treatment facilitates the molding of the metal plate, the acid pickling treatment facilitates rust removal and edge cutting, the cold rolling subsequent to the hot rolling facilitates to eliminate pores, and the continuously hot-dip galvanizing treatment subsequent to cold rolling can not only realize annealing effect but also enhance antioxidation property of the metal plate.

3. The present invention provides a method for producing a patterned insulation board used for exterior wall of building by using screen printing. In the step b, before printing the patterns, the metal plate is treated by following treatment process of: degreasing treatment, cleaning treatment, first drying treatment, passivating treatment, second drying treatment, coating primer paint treatment, baking for curing treatment, and cooling treatment. Due to the above preprocessing steps, the adhesive force between the paints and the metal plate to be printed during the roller coating process is effectively increased, and the molding property of the metal veneer is improved.

4. The present invention provides a method for producing a patterned insulation board used for exterior wall of building by using screen printing. In the step B of this method, a rock wool with a density of 120 kg/m$^3$ is used as the insulation layer, and the fiber orientation of the rock wool is perpendicular to the metal veneer and the substrate. The strength of the insulation layer is enhanced due to the reasonable selection of density. The fiber orientation of the rock wool is perpendicular to the metal veneer and the substrate, ensuring that the rock wool will not easily slide and dislocate with the metal veneer and the substrate, thus improving the rigidity.

DETAILED DESCRIPTION OF THE EMBODIMENTS

Embodiment 1

This embodiment provides a method for producing a patterned insulation board used for exterior wall of building by using screen printing, comprising in sequence the following steps of A. a step of producing a metal veneer and a substrate; and B. a step of adding an insulation layer between the metal veneer and the substrate to produce the patterned insulation board.

Wherein, the production of the metal veneer in step A comprises in sequence the following steps of a. producing a metal plate, which comprises in sequence the following steps of: hot rolling steel coils, acid pickling the hot rolled steel coils with hydrochloric acid, cold rolling the acid pickled steel coils, and continuously hot dip galvanizing the cold rolled steel coils at 650° C. (or at other temperatures chosen from 650° C. to 850° C.) to form the metal plate. Herein, continuously hot-dip galvanizing at 650° C. is equivalent to carrying out hot-dip galvanizing treatment subsequent to annealing treatment, improving both mechanical property and antioxidation property;

b. treating the metal plate before printing patterns, which comprises following treatment process: degreasing treatment, cleaning treatment, pre-drying treatment, passivating treatment, first drying treatment, coating primer paint treatment, baking for curing treatment, and first cooling treatment. In detail, in the degreasing treatment, an alkali liquor with an concentration of 1% and an the degreasing is performed at the temperature of 50-65 degrees so as to remove oil and dust from the surface of the strip steel, and in the alkali liquor, the ratio of total alkali to free alkali is less than 2.5; in the cleaning treatment, desalted water having a temperature of 50-65 degrees and a PH value less than 7.8 is used to wash the surface of the strip steel after degreasing treatment, so as to remove residual alkali liquor on surface of the strip steel; in a first drying treatment, hot air having a temperature of 75-85 degrees heated by a vapor heat exchanger is used to dry the surface of the strip steel after cleaning so as to remove residual water thereon; in the passivating treatment, the surface of the strip steel after cleaning is passivated with a treating solution having Chromium weight of 22-32, so as to increase the adhesion force between the strip steel and the primer paint and also increase the antiseptic property; in a second drying treatment, the passivated surface is dried by an electrical heating oven at a baking temperature of 75-85 degrees, in order to enhance passivation effect. In the coating primer paint treatment, the first roller coating unit is used to coat primer paint and back paint on the surface of the strip steel, and the colour and the property of the primer paint depend on the patterns to be printed; in the baking for curing treatment and first cooling treatment, the strip steel coated with the primer paint and the back paint is baked to allow the primer paint and the back paint to be fully dried at temperature of 214-232 degrees, then the strip steel is cooled by water spay and flow to further stabilize the property of the primer paint and the back paint;

c. printing patterns on the metal plate by using screen printing equipment which comprises a screen printing machine used for printing patterns on the metal plate and a printing table used for placing the metal plate to be printed, so as to form the metal veneer; a flattening device is arranged at a bottom of the printing table, and used to flatten metal plate, prior to the screen printing.

This embodiment provides a flattening method as follows: the printing table is made of ferromagnetic material, and a magnet coil is arranged at a lower part of the printing table corresponding to a placement position of the metal plate and is connected with an energizing control device which is controlled to make the magnet coil energized when flattening so that the printing table is magnetized and the magnetized printing table attracts the metal plate and flattens the same, in the step c, flattening the metal plate is first, then printing patterns by using the screen printing machine, followed by curing treatment by using an infrared ray curing oven.

The present invention, the number of screen printing machines and infrared ray curing ovens of screen printing equipment can be chosen as required. There are four screen printing machines and four infrared ray curing ovens so as to realize to print four-colour patterns.

In the present embodiment, in order to improve the adhesive force between the ink and the metal plate, corona treatment on the surface of the metal plate is performed between the flattening process and printing process by using the corona machine; and in order to increase the surface purification, a step of electrostatic precipitation treatment between the corona treatment step and the screen printing step by using electrostatic precipitation equipment.

In the present embodiment, in order to improve brightness of the ground-colour patterns and protection for the same, a post processing treatment is performed to the metal plate after screen printing, and the post processing treatment comprises steps of spraying gloss paint on the surface of the metal plate, and then performing a third drying treatment, followed by a second cooling treatment.

In the present embodiment, in the step B, the patterned insulation board is produced by the following process of: firstly, treating the metal veneer and the substrate respectively by coating, pressing and gluing, and gluing the insulating layer, and then arranging the insulation layer between the metal veneer and the substrate and pressing to form the patterned insulation board; rock wool with a density of 120 $kg/m^3$ is used as the insulation layer, and the fiber orientation of the rock wool is perpendicular to the metal veneer and the substrate; a polyurethane foaming agent is used in the gluing treatment; in order to improve water-resistance performance, after the insulation layer is arranged between the metal veneer and the substrate and is treated by pressing to form the patterned insulation board, and the polyurethane foaming agent is used for sealing edge of the patterned insulation board.

Embodiment 2

The present embodiment is a variation of production method of embodiment 1, in which the flattening device is different from embodiment 1. In the present embodiment, a plurality of through holes are arranged at the printing table corresponding to a placement position of the strip steel, and a fan is arranged at a bottom of the printing table and adapted for sucking air through the through holes.

When flattening, because a plurality of through holes are arranged at the printing table, it will form a gap between the metal plate and the printing table due to unevenness of the metal plate, therefore, when the fan sucks air through the through holes, the air would flow towards to the fan through the through holes, and a negative pressure area in a clearance space may be formed between the metal plate and the printing table, and the metal plate is further pressed towards the printing table, and the flattening is completed.

While particular embodiments of the invention have been shown and described, it will be obvious to those skilled in the art that changes and modifications may be made without departing from the invention in its broader aspects, and therefore, the aim of the appended claims is to cover all such changes and modifications as fall within the true spirit and scope of the invention.

The invention claimed is:

1. A method for producing a patterned insulation board used for an exterior wall of a building by using screen printing, comprising in sequence the following steps of (A) producing a metal veneer and a substrate; and (B) arranging an insulation layer between the metal veneer and the substrate to form the patterned insulation board;

wherein, the process of producing the metal veneer in step (A) comprises in sequence the following steps of (a) producing a metal plate;

(b) treating the metal plate before printing patterns;

(c) printing patterns on the metal plate by using screen printing equipment which comprises a screen printing machine used for printing patterns on the metal plate by screen printing and a printing table used for placing the metal plate to be printed, so as to form the metal veneer; wherein, a flattening device is arranged at a bottom of the printing table, and used to flatten a surface of metal plate, prior to the screen printing;

the screen printing equipment comprises an infrared ray curing oven for curing the patterns, which is compatible with the screen printing machine;

in the step (a), the metal plate is produced by a process comprising in sequence the following steps of: hot rolling steel coils, acid pickling the hot rolled steel coils, cold rolling the acid pickled steel coils, and continuously hot dip galvanizing the cold rolled steel coils to form the metal plate;

before printing the patterns, the metal plate is treated by following treatment process of: degreasing treatment, cleaning treatment, first drying treatment, passivating treatment, second drying treatment, coating primer paint treatment, baking for curing treatment, and cooling treatment;

in the step (B), the patterned insulation board is produced by the following process of: firstly, treating the metal veneer and the substrate respectively by coating, pressing and gluing, and gluing the insulating layer in a gluing treatment, and then arranging the insulation layer between the metal veneer and the substrate and pressing to form the patterned insulation board; rock wool with a density of 120 $kg/m^3$ is used as the insulation layer, and the fiber orientation or the rock wool is perpendicular to the metal veneer and the substrate; a polyurethane foaming agent is used in the gluing treatment;

in the step (B), after the insulation layer is arranged between the metal veneer and the substrate and is treated by pressing to form the patterned insulation board, the polyurethane foaming agent is used for sealing an edge of the patterned insulation board.

2. The method of claim 1, wherein, the printing table is made of ferromagnetic material, and a magnet coil is arranged at a lower part of the printing table corresponding to a placement position of the metal plate and is connected with an energizing control device.

3. The method of claim 1, wherein, a plurality of through holes are arranged at the printing table corresponding to the placement position of the metal plate, and a fan is arranged at the bottom of the printing table and adapted for sucking air through the through holes.

* * * * *